US006673171B2

(12) United States Patent
Hlady et al.

(10) Patent No.: US 6,673,171 B2
(45) Date of Patent: Jan. 6, 2004

(54) MEDIUM CARBON STEEL SHEET AND STRIP HAVING ENHANCED UNIFORM ELONGATION AND METHOD FOR PRODUCTION THEREOF

(75) Inventors: Craig O. Hlady, Murrysville, PA (US); Todd M. Osman, Murrysville, PA (US)

(73) Assignee: United States Steel Corporation, Pittsburgh, PA (US)

( * ) Notice: Subject to any disclaimer, the term of this patent is extended or adjusted under 35 U.S.C. 154(b) by 0 days.

(21) Appl. No.: 10/222,222

(22) Filed: Aug. 16, 2002

(65) Prior Publication Data

US 2003/0019550 A1 Jan. 30, 2003

Related U.S. Application Data

(63) Continuation-in-part of application No. 09/654,122, filed on Sep. 1, 2000, now abandoned.

(51) Int. Cl.[7] ..... C21D 8/02
(52) U.S. Cl. ..... 148/603; 148/651
(58) Field of Search ..... 148/603, 651

(56) References Cited

U.S. PATENT DOCUMENTS

| | | | |
|---|---|---|---|
| 4,021,272 | A | 5/1977 | Asai et al. |
| 5,108,518 | A | 4/1992 | Fukui et al. |
| 5,252,153 | A | 10/1993 | Ochi et al. |
| 5,454,887 | A | 10/1995 | Fukui |
| 5,505,796 | A | 4/1996 | Kawano et al. |
| 5,516,373 | A | 5/1996 | Dries et al. |

FOREIGN PATENT DOCUMENTS

| | | | |
|---|---|---|---|
| JP | 61-076619 | | 4/1986 |
| JP | 31-22216 | | 5/1991 |
| JP | 57-134576 | | 8/1992 |
| JP | 08120405 | * | 5/1996 |
| JP | 08246051 | * | 9/1996 |
| JP | 10-060540 | | 3/1998 |
| JP | 11-264049 | | 9/1999 |

OTHER PUBLICATIONS

O'Brien et al, "Spheroidization of Medium–Carbon Steels" JMEPEG, 1997, pp. 69–72, vol. 6, No. 1.

* cited by examiner

*Primary Examiner*—Sikyin Ip
(74) *Attorney, Agent, or Firm*—W. F. Riesmeyer, III; E. H. Jones, Jr.

(57) ABSTRACT

A method is provided for producing medium carbon steel sheet and strip with enhanced uniform elongation for deep drawing applications. In one embodiment, a steel slab containing carbon 0.30/0.70%, manganese 0.75/2.0%, silicon up to 1.0% max., total aluminum 0.020/0.10%, the balance iron and incidental impurities is hot rolled to strip at a finishing temperature within the range of 839° C. (1542° F.) to 773° C. (1424° F.) and spheroidize annealed at a temperature below the $A_1$ temperature. In a second embodiment, a steel slab containing 0.40 minimum/0.70% maximum carbon, 0.50/1.50% manganese, up to 1.0% silicon, 0.020/0.10% total aluminum, the balance iron and incidental impurities is hot rolled, cold rolled and spheroidize annealed, with various combinations of manganese and silicon within the above ranges providing lower yield strength at levels of 60 ksi, 70 ksi, and 80 ksi with minimum 14% uniform elongation.

6 Claims, 4 Drawing Sheets

MEDIUM CARBON STEEL SHEET AND STRIP HAVING ENHANCED UNIFORM ELONGATION AND METHOD FOR PRODUCTION THEREOF

This application is a continuation-in-part of U.S. Ser. No. 09/654,122 filed Sep. 1, 2000 now abandoned.

TECHNICAL FIELD

This invention relates to a process for producing medium carbon steel sheet and strip with a spheroidized microstructure having enhanced uniform elongation suitable for deep drawing applications. In one embodiment for producing the steel in hot rolled and annealed form, the steel is hot rolled with a lower than normal finishing temperature and subsequently annealed at a temperature below the $A_1$ to provide an unexpected increase in uniform elongation. In a second embodiment for producing the steel in cold rolled and annealed form, increased lower yield strength levels are unexpectedly achieved at the higher end of the carbon range without significant decrease in uniform elongation by interaction of Mn and Si at various levels with the higher carbon.

BACKGROUND ART

There is a need for steel products having high strength and uniform elongation. High uniform elongation is particularly useful where the steel is to be formed into parts for automotive applications. In order to decrease the weight of cars and other vehicles, high strength along with high uniform elongation is particularly desired so that thinner gauge steels may be used. Dual phase steels developed for automotive applications typically have a proeutectoid ferrite microstructure with a significant fraction of low carbon martensite and/or lower bainite to provide high strength and high formability. Dual-phase steels generally require the addition of expensive alloying elements to increase hardenability and special cooling practices on a continuous annealing line or a hot strip mill to control the microstructure. Continuous annealing lines having controlled cooling capability are very expensive and require a substantial outlay of capital funds. There is a need therefore for steel producers that do not have continuous annealing lines with controlled cooling capability to be able to produce high strength steels having high uniform elongation using conventional batch or box annealing facilities.

A spheroidizing anneal below the $A_1$ temperature is disclosed in U.S. Pat. No. 5,108,518 to Fukui et al. The reference discloses a method of manufacturing a steel sheet having high strength and excellent resistance to hydrogen embrittlement after heat treatments performed subsequent to the spheroidizing anneal. The steel is used for articles such as chain elements, gear members, clutch members, buckles for seat belts and washers. The steel consists essentially of C 0.30/0.70, Si 0.10/0.70, Mn 0.05/1.00, P not greater than 0.030, S not greater than 0.020, Cr 0.50/2.00, Mo 0.10/0.50, Ti 0.005/0.10, Nb 0.005/0.10, sol. Al not greater than 0.10, N greater than 0.002 but not greater than 0.015, optionally B 0.0005/0.002, balance iron and incidental impurities. The method includes hot rolling the steel with a finishing temperature of 800° C. or higher, cooling at a rate of 5–40° C./second to a temperature range of 500–700° C. The hot rolled steel may optionally be cold rolled 20–80% and box annealed at a temperature of $(A_{c1}-50)$ to $(A_{c1}+30)$° C. for one hour or longer to spheroidize the cementites. Thin steel sheet produced by this method is formed and shaped by the customer and then subjected to heat treatment to provide sufficient hardness of the final product. The reference does not teach a hot rolled product that is spheroidize annealed, nor that lower hot roll finishing temperature will increase the uniform elongation of hot rolled steel strip after a spheroidizing anneal. The reference also does not teach the interaction of C, Mn, and Si for achieving various higher strength levels of cold rolled and spheroidize annealed strip product without substantial decrease in uniform elongation.

Several other references disclose spheroidization annealing of carbon steels below the $A_1$ temperature. JP 11 264049 discloses a method of producing a high carbon steel strip free from shape defects such as sagging. The steel contains 0.2/0.8 C, up to 0.3 Si, 0.6/1.6 Mn, 0.01/0.1 sol. Al, 0.002/0.01 N, sol. Al/N: 5 to 10 and 0/0.01 Ca, the balance Fe with inevitable impurities. The steel is hot rolled, finish rolling at 850° C. (from the example), coiled at 550/680° C., cold rolled 10/80% annealed at 650/725° C. and secondary cold rolled 5/25%. The spheroidizing ratio is regulated to up to 80%. Tensile strength (TS) is regulated between 600 to 700 N/mm2 and the TS (N/cm2)×(100−El %): 50×103 to 65×103. This reference does not disclose steel having high uniform elongation, nor controlling the hot roll finishing temperature to obtain high uniform elongation. The reference also does not disclose the interaction of C, Mn and Si on lower yield strength without significant decrease in uniform elongation after a spheroidizing anneal in cold rolled form. JP 57 134457 discloses improving the rate of spheroidization of the entire part of a hot rolled steel strip. The middle to high carbon steel is hot rolled, coiled and reheated after which it is again coiled. It is then mechanically descaled, pickled and spheroidization annealed. Applicants' invention does not require reheating after hot rolling prior to a spheroidization anneal. JP 10 060540 discloses prevention of seizing flaws in steel strip. The steel is hot rolled to strip, pickled, descaled and repeatedly subjected to soaking and slow cooling below and above the A1 temperature. The spheroidizing rate improves and the production of a soft hot rolled steel strip is made possible. The strip is then cold rolled 20/85% and final annealed at a temperature between 630° C. to the $A_{c1}$ temperature. This reference discloses additional reheating after hot rolling before cold rolling and spheroidize annealing which is unnecessary in Applicants' invention. JP 61 076619 discloses a high carbon cold rolled steel strip having superior ductility. The steel contains 0.27/0.90 C, 0.15/0.30 Si, 0.60/0.90 Mn, up to 0.030 P, up to 0.035 S, and the balance Fe and inevitable impurities. The hot rolled strip is annealed for 15 hours at a temperature within the range 680/720° C., cold rolled 20/45% and then annealed for 10 hours at a temperature within the same temperature range as the hot roll anneal. This reference requires a spheroidization anneal after both hot rolling and cold rolling which is not required in Applicants' invention. Also this reference does not disclose hot rolling with a lower than normal finishing temperature to obtain enhanced uniform elongation. JP 31 22216 discloses a process for producing a cold rolled steel strip under the following conditions when the carbon content of the steel is less than 0.6%. The steel is hot rolled, coiled at a temperature within the range of 460–600° C., cooled after hot rolling at a velocity regulated to 30–45° C., cold rolled 50–85% and spheroidize annealed at a temperature between 680° C. and the Ac3 temperature. This reference requires control cooling of the coil after hot rolling which is not required in Applicants' invention. The reference also does not restrict the spheroidization temperature to a temperature below the A1 temperature.

A reference in which a sub-critical anneal is used to graphitize 50% or more of the cementite is disclosed in U.S.

Pat. No. 5,454,887 to Fukui. The steel consists essentially of C 0.20/0.70, Si 0.20/2.00, Mn 0.05/0.50, P not more than 0.020, S not more than 0.010, sol. Al 0.01/1.00, B 0.0003/0.005, N 0.002/0.010, B/N 0.2/0.8, Cu 0/1.00, Ni 0/2.00, Ca 0/0.010, balance iron and incidental impurities. The steel is hot rolled with a finishing temperature of 700–900° C., cooled at a rate of 5–50° C./second and coiled at 400–650° C. The steel is optionally cold rolled 20–85% and annealed at a temperature of 600° C. to the $A_{c1}$ temperature for 1 hour or longer. The upper limit of 0.50% Mn is essential to ensure formation of graphite during the sub-critical anneal. To obtain graphitization, the chemical composition of the steel must be such that cementite is unstable at the temperature and time of the sub-critical anneal so as to permit breakdown of cementite into its constituent elements with the carbon going into its stable form as graphite. Applicants' invention does not involve graphitization of the carbides in the steel. The reference does not teach the effect of lower finishing temperature on uniform elongation, or the interaction of C, Mn and Si on lower yield strength without decrease in uniform elongation.

A literature paper entitled "Spheroidization of Medium-Carbon Steels" by J. M. O'Brien and W. F. Hosford, Journal of Materials Engineering and Performance, February, 1997, Vol. 6, pages 69–72, discloses spheroidization of AISI 4037 steel rod using both intercritical and subcritical annealing cycles to provide good cold formability of bolts made from the hot rolled rod. The paper discloses that bolts to be hardened by subsequent heat treatment are made from medium-carbon steel (0.35 to 0.50% C) alloyed for hardenablility with chromium, manganese and molybdenum. Rods of these steels are hot drawn to final diameter, coiled, and cooled for delivery. The structure at this point is ferrite and pearlite, with the coarseness of the pearlite depending on the rate of cooling after coiling. A spheroidization anneal is performed to provide sufficient formability for cold heading in which the head of the bolt is upset forged with a female die to form the bolt head. The reference does not teach or suggest that medium carbon steel sheet with high uniform elongation could be obtained by a spheroidization anneal below the $A_1$ temperature, nor the effect of lower than normal finishing temperature on uniform elongation. The reference also does not suggest the interaction of C, Mn and Si on lower yield strength without decrease in uniform elongation in cold rolled and annealed steel strip.

A reference in which hot rolling of steel wire rod both above and below the $A_1$ temperature is required in order to obtain a greater degree of spheroidization and softening is disclosed in U.S. Pat. No. 5,252,153 to Ochi et al. The steel contains 0.1 to 1.5% C, 0.25 to 2.0% Mn, balance iron and unavoidable impurities. Hot rolling is conducted at a temperature just above the $A_{r3}$ or just above the $A_{rcm}$ with a total reduction of area of 30% or more to form a pearlite having large lamellar spacing at the completion of transformation. The steel is further hot rolled at a temperature of from $A_{c1}$–400° C. to the $A_{c1}$ with a total reduction of area of 10% to 70%. Spheroidization annealing is carried out by holding at a temperature of from 700 to 820° C. for 2 to 7 hours and then gradually cooling the heated material to a temperature of from 600 to 720° C. at a cooling rate of 0.1 to 1.0° C./minute. Tensile strength after spheroidizing is reported lower and the degree of spheroidization is greater after hot rolling according to the process disclosed by the reference. The present invention does not involve hot rolling below the $A_{c1}$ temperature.

A high strength hot rolled steel sheet having excellent formability and spot weldability is disclosed in U.S. Pat. No. 5,505,796 to Kawano et al. In one embodiment the steel contains 0.15/less than 0.30 C, 0.5/3.0 Si, 0.5/3.0 Mn, more than 1.5 to 6.0 Si and Mn, not more than 0.02 P, no more than 0.01 S, and 0.005/0.10 Al, the balance essentially iron. The steel is hot rolled with a finish temperature in the range of $A_{r3}$±50° C. at an entire draft of not less than 80% and an ultimate strain speed of not less than 30/second. The steel is cooled on a hot runout table at a rate of not less than 30° C./second followed by coiling at a temperature of more than 350 to 500° C. The steel has a uniform elongation of not less than 10%. The reference does not disclose a spheroidizing anneal, nor the effect of lower than normal hot roll finishing temperature on uniform elongation after a spheroidizing anneal. The reference also does not disclose the interaction of C, Mn and Si on lower yield strength without significant decrease of uniform elongation in cold rolled and spheroidize annealed steel strip.

U.S. Pat. No. 4,021,272 to Asai et al discloses spheroidization annealing of a coil of hot rolled band steel for tools and razor blades by immersion of the coil with its convolutions spaced apart a minimum of 2 mm in a salt bath. The coil is immersed for 5 to 30 minutes and held at a temperature in a range of 550 to 750° C. The reference does not disclose lower than normal hot roll finishing temperature, nor the interaction of C, Mn and Si on lower yield strength.

U.S. Pat. No. 5,516,373 to Dries et al discloses austempering of hot and cold rolled steel strapping containing 0.25/0.34 C, 1.20/1.55 Mn, up to about 0.035 Si, 0.201/0.45 V, or 0.35/0.45 Mo plus 0.12/0.18 V. The austempering step involves passing the strip through a first lead bath to preheat the strip to about 850° F., resistance heating the strip to about 1600° F., passing the strip through a second lead bath at about 800° F. to quench the strip (and held at this temperature for about 8 seconds), and air-cooling to about 250° F. followed by water cooling to room temperature. The resulting product has a non-equilibrium microstructure of very fine spheroidized carbides in ferrite. The reference does not disclose a sub-critical spheroidizing anneal, nor a steel suitable for deep drawing applications.

DISCLOSURE OF INVENTION

The present invention is of a method for producing medium-carbon steel sheet and strip having enhanced uniform elongation suitable for deep drawing applications. The product may be produced in either hot rolled and annealed or cold rolled and annealed form. In a first embodiment for producing the steel in hot rolled and annealed form, the method includes providing a steel slab having a composition consisting of in weight percent: 0.30/0.70 carbon, 0.75/2.0 manganese, up to 1.0 silicon, 0.020/0.10 total aluminum, the balance iron and incidental impurities. The slab is hot rolled to strip with a finish rolling temperature within the range of 839° C. (1542° F.) to 773° C. (1424° F. and then coiled. The hot rolled coil is box annealed at a temperature not greater than the $A_1$ temperature, said temperature being within the range of $A_1$ to 677° C. (1250° F.). The temperature and time at temperature during box annealing being effective to transform substantially all of the carbides in the microstructure of the steel to spheroidized form so that essentially none of the carbides are transformed to graphite, and to provide said hot rolled and box annealed strip with a minimum uniform elongation of at least about 15% and a lower yield strength within a range of about 50 ksi to about 60 ksi. Preferably the steel has a C content of 0.30/0.40.

In a second embodiment of the invention for producing the steel in cold rolled and annealed form, the method includes providing a steel slab having a composition consisting of in weight percent: 0.40 minimum/0.70 maximum carbon, 0.50/1.50 manganese, up to 1.0 silicon, 0.020/0.10 total aluminum, the balance iron and incidental impurities. The slab is hot rolled with a finish rolling temperature within the range of 900° C. (1652° F.) to the $A_{r1}$ temperature and then coiled. The hot rolled coil is cold rolled and box annealed at a temperature not greater than the $A_1$ temperature, the temperature and time at temperature being effective to transform substantially all of the carbides in the microstructure to spheroidized form so that essentially none of the carbides are transformed to graphite and to provide the cold rolled and box annealed strip with a minimum lower yield strength of at least about 60 ksi and a minimum uniform elongation of at least about 14%. We have found that higher strength levels are achieved in cold rolled and annealed steels of this carbon range substantially without loss of uniform elongation by the interaction of manganese and silicon at various levels whereas the interaction effects are not found in the nominal 0.30%C cold rolled and annealed steels. The invention includes the steel products produced by the methods described above.

MODES FOR CARRYING OUT THE INVENTION

Figure 1:
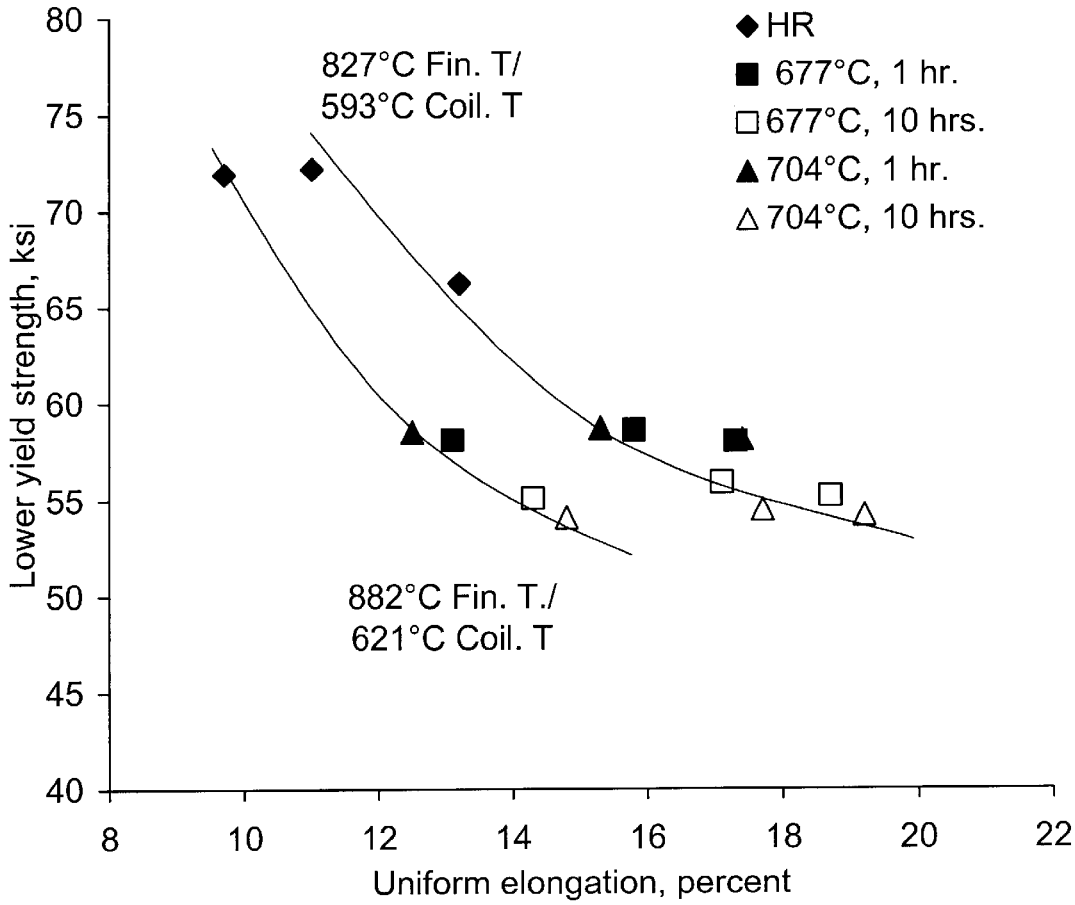
FIG. 1 is a graph of percent uniform elongation vs. lower yield strength in ksi of a commercially hot rolled steel strip nominally containing 0.35% C, 0.75% Mn, 0.1% Si. and 0.045% Al, based on samples given laboratory anneals, showing the increase in uniform elongation achieved by lowering the hot rolling finishing temperature from 882° C. (1620° F.) to 827° C. (1520° F.).

In a first embodiment for producing the steel in hot rolled and annealed form, a steel slab is made by conventional steelmaking practices and has a composition consisting of in weight percent: 0.30/0.70 carbon, 0.75/2.0 manganese, up to 1.0 silicon, 0.020/0.10 total aluminum, the balance iron and incidental impurities.

The reasons for selecting the above chemical composition are as follows:

Carbon:

In order to provide the steel with a satisfactory level of strength through the presence of spheroidal carbides, the carbon level should be at least 0.30%. When the carbon level is greater than 0.70% the steel becomes difficult to cast by the continuous casting process, ductility decreases below a desirable level, and welding becomes very difficult. Therefore, in the first embodiment of the present invention the carbon content is defined as 0.30 to 0.70%. Preferably the carbon content for the first embodiment is 0.30 to 0.40%.

Manganese:

Manganese is added in steelmaking to control hot-shortness during casting by combining with sulfur. In addition, with respect to this invention the addition of manganese helps to retard the formation of graphite during the subcritical anneal following hot or cold rolling, as well as increase the strength of the steel. Therefore, a minimum manganese content of 0.75% is desired. When the manganese content is over 2.0%, the ductility of the steel decreases below a desirable level, and increases the difficulty of welding the steel due to the increase of hardenability. Therefore, the desired level of manganese is 0.75 to 2.0%, and preferably 0.75 to 1.50%.

Silicon:

Silicon is required for extra strength at the higher carbon levels. As silicon content increases, hot rolling becomes more difficult and ductility decreases, therefore the desired upper level is 1.0%.

Aluminum:

Aluminum is generally added in an amount sufficient to provide at least 0.020% total aluminum in the steel in order to fully deoxidize the steel. Aluminum in amounts greater than a total of 0.10% increases the tendency for graphitization of the carbides during annealing and is undesirable.

Next in the first embodiment of this invention the slab is hot rolled to strip with a finish rolling temperature within the range of 839° C. (1542° F.) to 773° C. (1424° F.). The strip is coiled after hot rolling, preferably at a temperature within the range of 538° C. (1000° F.) to 677° C. (1250° F.). The strip preferably is pickled after hot rolling. The coiled strip is then annealed at a temperature not greater than the $A_1$ temperature, said temperature being within the range of $A_1$ to 677° C. (1250° F.). Preferably to provide uniform lower yield strength and percent uniform elongation throughout the length of the coil, the coil is batch annealed at a temperature within the range of 677° C. (1250° F.) to 704° C. (1300° F.) for a total time greater than twenty hours. The properties throughout the coil are very uniform. A commercial nominal 0.35 carbon steel annealed at 690° C. (1275° F.) for 29 hours produced a coil with hot spot/cold spot lower yield strength variation of less than two ksi and a total elongation variation of less than one percent. The temperature and the time at temperature are selected so as to be effective to transform substantially all of the carbides in the microstructure to spheroidized form so that essentially none of the carbides are transformed to graphite (a pure form of carbon), and provide said hot rolled and box annealed strip with a minimum uniform elongation of at least about 14% and a lower yield strength within the range of about 50 ksi to about 60 ksi. Uniform elongation is the elongation prior to the onset of plastic instability of a tensile test specimen rather than the elongation at the breaking point of the specimen, which is total elongation. Uniform elongation is a more accurate measure of the formability of the steel than total elongation. Most preferably the steel coil is box annealed in a gas atmosphere consisting essentially of pure hydrogen in order to keep property variation to a minimum, to obtain high surface quality and to keep surface decarburization to a minimum.

EXAMPLE 1

In an example of the first embodiment of this invention a commercial heat of steel was produced by conventional steelmaking and continuous casting. The heat had the following nominal chemical composition in weight percent: 0.35 C, 0.75 Mn, 0.1 Si, and 0.045 Al. Five of the slabs were hot rolled with an aim finishing temperature of 827° C. (1520° F.). The remaining slabs were hot rolled with a normal finishing temperature of 882° C. (1620° F.). The aim coiling temperature for all coils was 593° C. (1100° F.). The coils were pickled and temper rolled. Samples were taken at the temper mill 200 feet from the coil ends and in some cases from the center of the coil. Portions of samples from coils hot rolled at each finishing temperature were annealed in a laboratory furnace for one hour at 677° C. (1250° F.), one hour at 704° C. (1300° F.), and ten hours at each of those temperatures. The results are shown in FIG. 1. FIG. 1 shows that the coils rolled at the lower hot roll finishing temperature (827° C.) have a uniform elongation after box annealing of at least about 15% and up to about 19.5% and a lower yield strength within a range of about 50 ksi to about 60 ksi. Whereas the coils rolled at the conventional higher finishing temperature (882° C.) have a uniform elongation of from 12 to 14.5% with a lower yield strength within the same range as the steel rolled at the lower finishing temperature.

EXAMPLE 2

Figure 2:
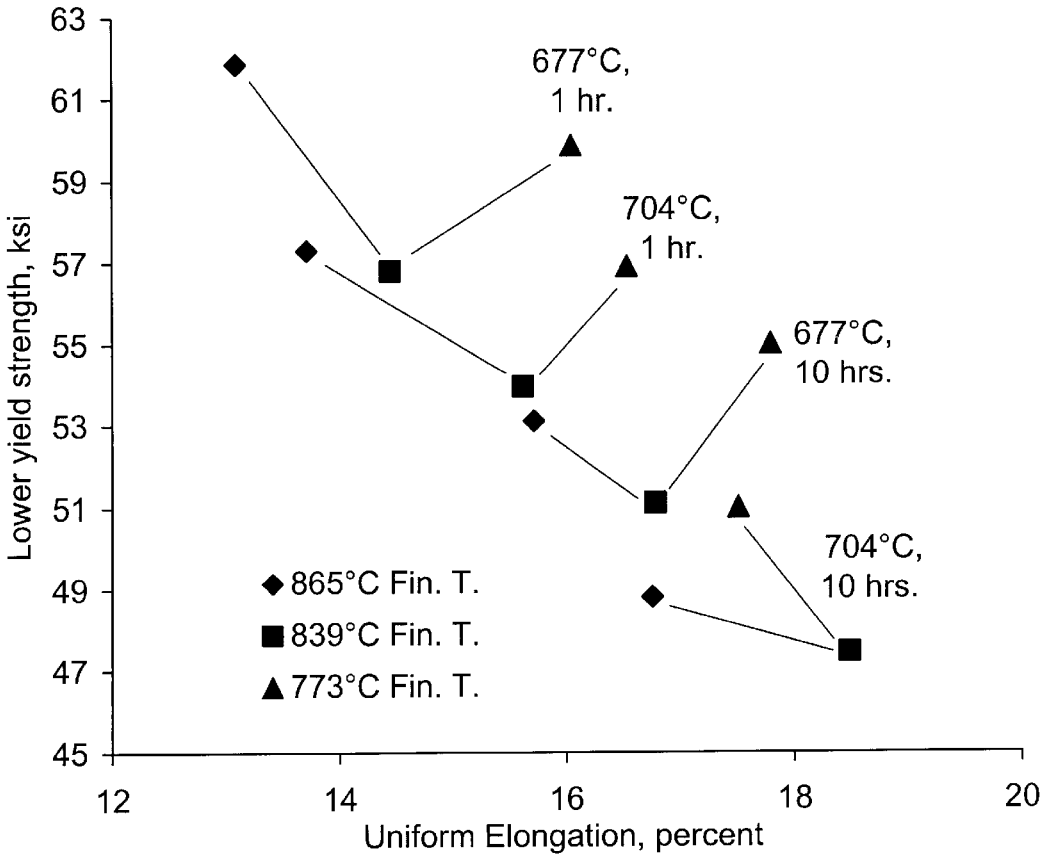
FIG. 2 is a graph similar to FIG. 1 for a laboratory melted, hot rolled and annealed steel nominally containing 0.5% C, 0.5% Mn, 0.04% Si showing the effect on uniform elongation and lower yield strength at three different hot roll finishing temperatures.

In a second example of the first embodiment of this invention a heat was melted in the laboratory having the following nominal composition: 0.5% C, 0.5% Mn, 0.04% Si. Individual slabs from the heat were hot rolled to strip with one of three hot roll finishing temperatures, 865° C. (1588° F.), 839° C. (1542° F.), and 773° C. (1424° F.). Individual portions of the sample strip from each finishing temperature were annealed for one or ten hours respectively at the same temperatures as in Example 1 above. The results are shown in FIG. 2. FIG. 2 shows that the 839° C. (1542° F.) finishing temperature increased the uniform elongation about 1%. The 773° C. (1424° F.) finishing temperature increased the uniform elongation about 2% (except for the ten hour 704° C. (1300° F.) anneal which appears to be an anomaly) as compared to the results at the 865° C. (1588° F.) finishing temperature.

In a second embodiment for producing the steel in cold rolled and annealed form, a steel slab is produced by conventional steelmaking practices and has a composition consisting of in weight percent: 0.40 minimum/0.70 maximum carbon, 0.50/1.50 manganese, up to 1.0 silicon, 0.020/0.10 total aluminum, the balance iron and incidental impurities.

The reasons for selecting the above chemical composition are as follows:

Carbon:

In order to provide cold rolled steel product with an enhanced level of strength through the presence of spheroidal carbides, the carbon level should be at least 0.40%. When the carbon level is greater than 0.70% the steel becomes difficult to cast by the continuous casting process, ductility decreases below a desirable level, and welding becomes very difficult. Therefore, in the second embodiment of the present invention the carbon content is defined as 0.40 to 0.70%. Preferably the carbon content for the second embodiment of this invention is 0.40 to 0.60%.

Manganese:

Manganese is added in this second embodiment in order to achieve the enhanced strength levels of the cold rolled and box annealed product. In addition, with respect to this invention the addition of manganese helps to retard the formation of graphite during the subcritical anneal following cold rolling, as well as to increase the strength of the steel. Therefore, a minimum manganese content of 0.50% is desired. When the manganese content is over 1.50%, the ductility of the steel decreases below a desirable level, and increases the difficulty of welding the steel due to the increase of hardenability. Therefore, the desired level of manganese is 0.50 to 1.50%.

Silicon:

Silicon provides extra strength at the higher carbon levels. As silicon content increases, hot rolling becomes more difficult and ductility decreases, therefore the desired level of silicon in this second embodiment is up to 1.0%.

Aluminum:

Aluminum is generally added in an amount sufficient to provide at least 0.020% total aluminum in the steel in order to fully deoxidize the steel. Aluminum in amounts greater than a total of 0.10% increases the tendency for graphitization of the carbides during annealing and is undesirable.

Next, in the second embodiment of this invention, the slab is hot rolled to strip with a finish rolling temperature within the range of 900° C. (1652° F.) to the $A_{r1}$ temperature. The strip is coiled after hot rolling, preferably at a temperature within the range of 538° C. (1000° F.) to 677° C. (1250° F.). The strip preferably is pickled after hot rolling. The strip is then cold rolled and the cold rolled coil is box annealed at a temperature not greater than the $A_1$ temperature. The box annealing temperature is controlled within a range of the $A_1$ temperature to 677° C. (1250° F.). The temperature and time at temperature are selected so as to be effective to transform substantially all of the carbides in the microstructure to spheroidized form so that essentially none of the carbides are transformed to graphite and to provide said cold rolled and box annealed strip with a minimum lower yield strength of at least 60 ksi and a minimum uniform elongation of at least 14%.

Figure 3:
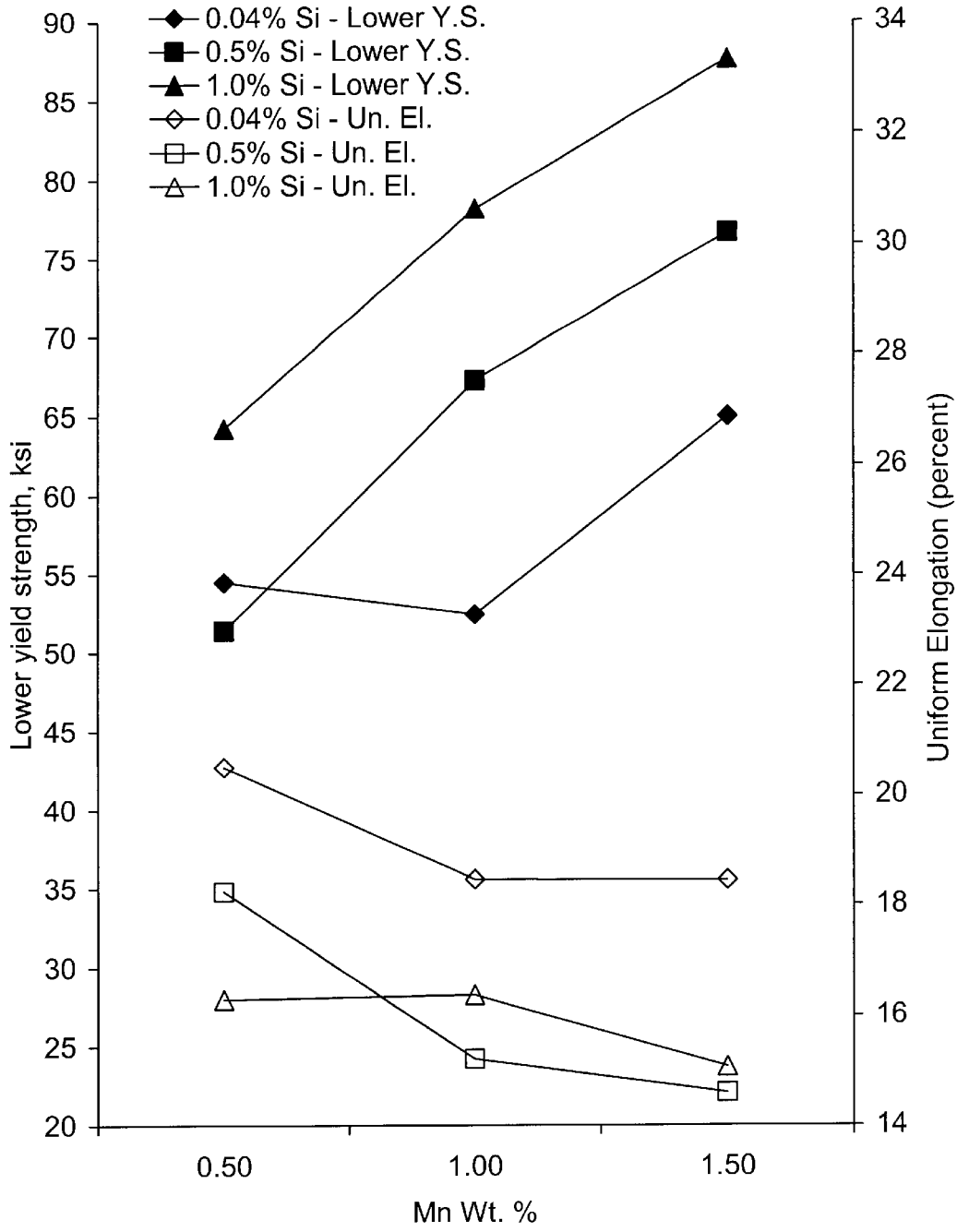
FIG. 3 is a graph of nominal 0.5% C laboratory heats that were hot rolled to strip, cold rolled and annealed showing the interaction of various levels of manganese and silicon in the steel of this carbon level so as to produce various higher levels of lower yield strength without substantial loss of uniform elongation according to the second embodiment of this invention.
Figure 4:
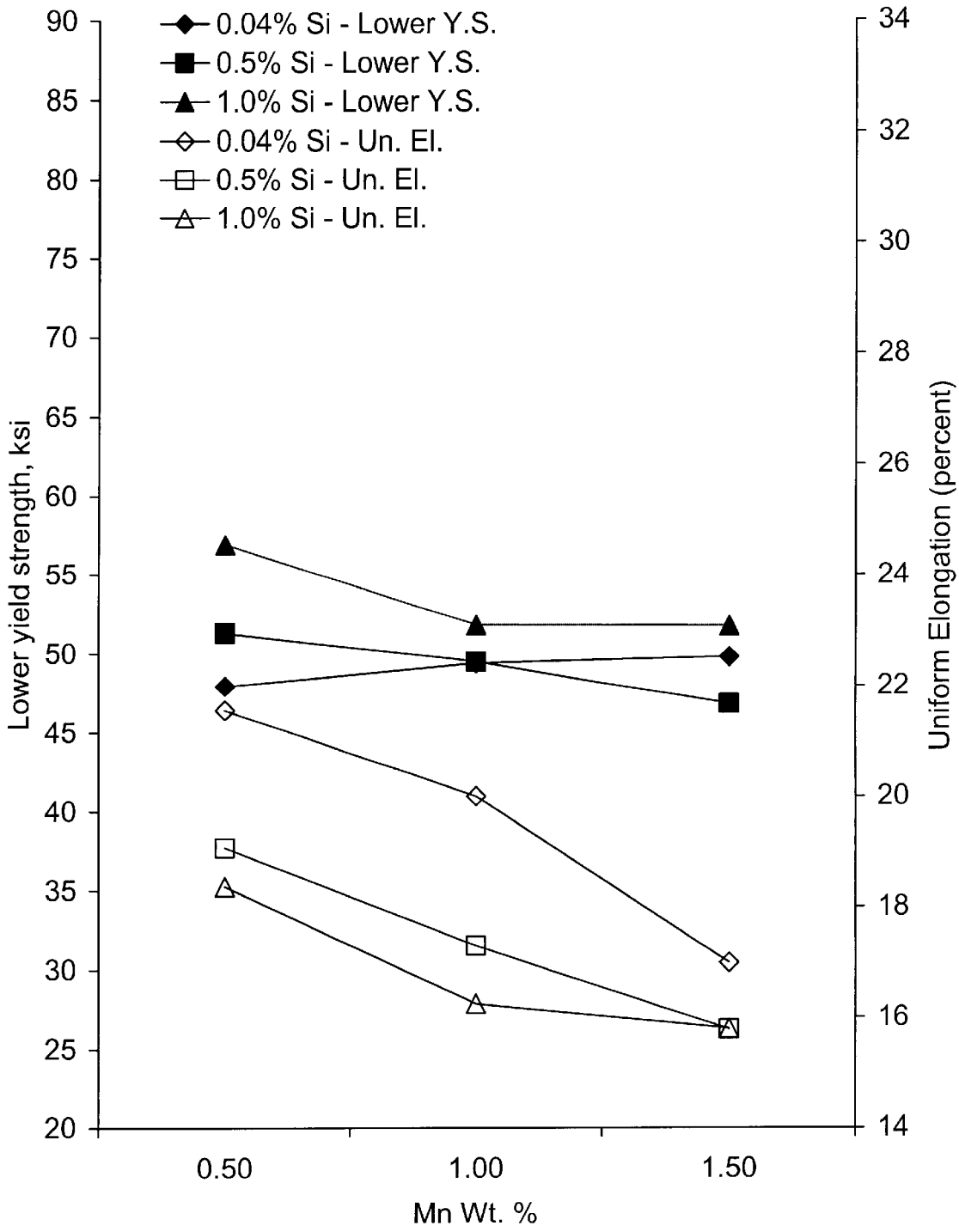
FIG. 4 is a graph of nominal 0.3% C laboratory heats that were hot rolled to strip, cold rolled and annealed showing that increased manganese and silicon do not produce higher strength in steels of that carbon content.

FIG. 3 shows that the lower yield strength and percent uniform elongation of the steel of this second embodiment can be adjusted by careful selection of the amount of manganese and silicon in the steel. For example, a minimum 60 ksi lower yield strength steel having a minimum 18 percent uniform elongation may be provided by a steel having manganese within a range of 0.50 to 1.50% and a silicon content of up to 1.0%. Or a minimum 70 ksi lower yield strength steel having a minimum 14 percent uniform elongation may be provided by a steel having manganese within a range of 1.0 to 1.50% and silicon within a range of 0.5% to 1.0%. Finally a minimum 80 ksi lower yield strength steel having minimum 14 percent uniform elongation may be provided by a steel having manganese of about 1.5% and a silicon content of about 1.0%. FIG. 4 shows that for carbon levels within the lower portion of the range of the first embodiment, i.e. the hot rolled product, increases in manganese and silicon level do not provide increases in strength achieved in the higher carbon cold rolled and box annealed steel of this second embodiment. The interaction of manganese and silicon at the higher carbon level of the cold rolled and box annealed steel while maintaining substantially the same percent uniform elongation was quite unexpected.

What is claimed is:

1. A method for producing a medium carbon hot-rolled steel strip having enhanced uniform elongation at room temperature, said method comprising:

a) providing a steel slab having a composition in weight percent consisting of carbon 0.30/0.70, manganese 0.75/2.0, silicon up to 1.0 max., total aluminum 0.020/0.10, the balance iron and incidental impurities;

b) hot-rolling said steel slab to strip with a hot roll finishing temperature within the range of 839° C. (1542° F.) to 773° C. (1424° F.);

c) coiling the hot rolled steel strip;

d) box annealing the hot rolled coil at a temperature no greater than the $A_1$ temperature, said temperature being within a range of $A_1$ to 677° C. (1250° F.), said temperature and the time at temperature being effective to transform substantially all of the carbides in the microstructure to spheroidized form and so that essentially none of the carbides are transformed to graphite, said hot rolled and box annealed coil having a minimum uniform elongation of at least 15% and a lower yield strength within a range of about 50 ksi to about 60 ksi.

2. The method of claim 1 wherein the carbon content is within the range of 0.30/0.40.

3. A method of producing a cold rolled medium carbon steel strip having enhanced lower yield strength and uniform elongation, said method comprising:

a) providing a steel slab having a composition consisting of in weight percent: 0.40 minimum/0.70 maximum carbon, 0.50/1.50 manganese, up to 1.0 silicon, 0.020/0.10 total aluminum, the balance iron and incidental impurities;

b) hot rolling the slab to strip with a finish rolling temperature within the range of 900° C. (1652° F.) to the $A_{r1}$ temperature;

c) coiling the hot rolled strip;

d) cold rolling the hot rolled coil;

e) box annealing the cold rolled coil at a temperature not greater than the $A_1$, said temperature being within the range of $A_1$ to 677° C. (1250° F.), the temperature and time at temperature effective to transform substantially all of the carbides in the microstructure to spheroidized form so that essentially none of the carbides are transformed to graphite, and to provide said cold rolled and box annealed strip with a minimum lower yield strength of at least 60 ksi and a minimum uniform elongation of 14%.

4. The method of claim 3 wherein said steel strip has a carbon content within the range of 0.40/0.60%.

5. The method of claim 3 wherein said steel has a manganese content of 1.00/1.50, a silicon content of 0.5/1.0%, and the temperature and time at temperature are effective to provide said steel with a minimum lower yield strength of at least 70 ksi and a minimum uniform elongation of at least 14%.

6. The method of claim 3 wherein said steel has a manganese content of about 1.5% and a silicon content of about 1.0%, and the temperature and time at temperature are effective to provide said steel with a minimum lower yield strength of at least about 80 ksi and a minimum uniform elongation of at least 14%.

* * * * *